United States Patent [19]

Iijima et al.

[11] 4,104,954

[45] Aug. 8, 1978

[54] HYDRAULIC CONTROL SYSTEM

[75] Inventors: Katsuhiko Iijima; Katsumasa Jomen, both of Sagamihara, Japan

[73] Assignee: Mitsubishi Jukogyo Kabushiki Kaisha, Tokyo, Japan

[21] Appl. No.: 511,380

[22] Filed: Oct. 2, 1974

[30] Foreign Application Priority Data

Oct. 31, 1973 [JP] Japan ..... 48-122545

[51] Int. Cl.[2] ..... F15B 15/26

[52] U.S. Cl. ..... 91/45; 91/411 R; 91/461; 214/131 A

[58] Field of Search ..... 214/131 A; 91/411 R, 91/461, 41, 45, 14, 420; 137/596.13; 192/3 N

[56] References Cited

U.S. PATENT DOCUMENTS

| | | | |
|---|---|---|---|
| 2,701,552 | 2/1955 | Light | 91/45 |
| 2,769,430 | 11/1956 | Geyer | 91/45 X |
| 2,778,378 | 1/1957 | Presnell | 91/420 X |
| 3,176,590 | 4/1965 | Uhtenwoldt et al. | 91/45 |
| 3,407,946 | 10/1968 | Pilch | 91/411 R |
| 3,499,543 | 3/1970 | Updegrave | 91/41 X |
| 3,541,927 | 11/1970 | Iijima | 91/410 |
| 3,543,646 | 12/1970 | Iijima | 91/414 |
| 3,610,450 | 10/1971 | Demkiw | 214/131 A X |

*Primary Examiner*—William L. Freeh
*Assistant Examiner*—Edward Look
*Attorney, Agent, or Firm*—Cushman, Darby & Cushman

[57] ABSTRACT

The invention is a hydraulic control system for use in positioning and clamping a movable object on a support, which system is adapted to be connected to a source of pressurized hydraulic fluid, to a hydraulically operated piston-cylinder assembly connected to the movable object for moving the movable object and to a hydraulically operated clamp and which comprises a path for the supply of pressurized fluid to and from the hydraulically operated clamp, a check valve in the path which check valve normally prevents return of fluid from the hydraulically operated clamp, a hydraulically operated pilot piston movable between a non-actuating position and an actuating position in which it opens the check valve, a path for the supply of pressurized fluid to the piston-cylinder assembly, which path is connected on its high pressure side to the hydraulically operated pilot piston, and a switching valve for controlling the supply of pressurized fluid to the piston-cylinder assembly, the arrangement being such that when the system is connected to the source of pressurized hydraulic fluid, to the piston-cylinder assembly and to the hydraulically operated clamp, when the switching valve is moved from its neutral position pressurized fluid is supplied to the piston-cylinder assembly to move the movable object and the pressurized fluid also acts on the pilot piston to move it to its actuating position to open the check valve, so that pressurized fluid can flow from the hydraulically operated clamp and the clamping force is relaxed to permit movement of the object.

The invention is particularly useful for a back-hoe on an excavator.

2 Claims, 7 Drawing Figures

HYDRAULIC CONTROL SYSTEM

This invention relates to a hydraulic control system for use in moving an object along a support beam and then clamping the object to the support beam. The hydraulic control system may be used for example, on an excavator having a back hoe which is movable horizontally on a support beam of the excavator. The hydraulic system clamps the back hoe in a selected position on the support beam and, when it is desired to move the back hoe, the hydraulic system controls the release of the hydraulic pressure clamping the back hoe, the sliding of the back hoe along the support beams to the newly selected position and the clamping of the back hoe in the new position.

FIG. 1 shows such a hydraulic system known in Japan. A hydraulic circuit for carrying out side-slide by means of hydraulic pressure is provided with a switching valve 1 for sliding the back hoe along the support beam and a separate shut-off valve 2 for a hydraulic fastening mechanism for clamping the back hoe to the support beam. When it is desired to move the back hoe along the support beam, first the shut-off valve 2 is manually released to reduce the pressure in fastening cylinders 3. After the hydraulic pressure in fastening cylinders 3 has been lowered, the back hoe is transferred by manipulating the side-slide switching valve 1 which controls the supply of fluid to a slide cylinder 4. Subsequently the back hoe is again clamped on the support beam by closing the shut-off valve 2. As described, in order to complete the entire operation of moving and then fastening the back hoe, the three operations of opening and closing the shut-off valve 2 and actuating the side-slide switching valve 1 were required. Accordingly, this apparatus had the disadvantage of complicated operation and also that complex and expensive members such as the side-slide switching valve 1 and the shut-off valve 2 were necessary.

According to the present invention there is provided a hydraulic control system for use in positioning and clamping a movable object on a support, which system is adapted to be connected to a source of pressurised hydraulic fluid, to a hydraulically operated piston-cylinder assembly connected to the movable object for moving the movable object and to a hydraulically operated clamp and which comprises a path for the supply of pressurised fluid to and from the hydraulically operated clamp, a check valve in the path which check valve normally prevents return of fluid from the hydraulically operated clamp, a hydraulically operated pilot piston movable between a non-actuating position and an actuating position in which it opens the check valve, a path for the supply of pressurised fluid to the piston-cylinder assembly, which path is connected on its high pressure side to the hydraulically operated pilot piston, and a switching valve for controlling the supply of pressurised fluid to the piston-cylinder assembly, the arrangement being such that when the system is connected to the source of pressurised hydraulic fluid, to the piston-cylinder assembly and to the hydraulically operated clamp, when the switching valve is moved from its neutral position pressurised fluid is supplied to the piston-cylinder assembly to move the movable object and the pressurised fluid also acts on the pilot piston to move it to its actuating positon to open the check valve, so that pressurised fluid can flow from the hydraulically operated clamp and the clamping force is relaxed to permit movement of the object.

Thus the invention provides a control system for a hydraulic transfer and fastening apparatus which, to facilitate movement of a movable body, is capable of performing both an operation of transferring the movable body in the left and right directions and a fastening operation for fixing the movable body on a frame with one manipulation of a lever.

The invention will be further illustrated with reference to FIGS. 2 to 7 of the accompanying drawings showing, by way of example, embodiments of the invention, in which.

Figure 1:
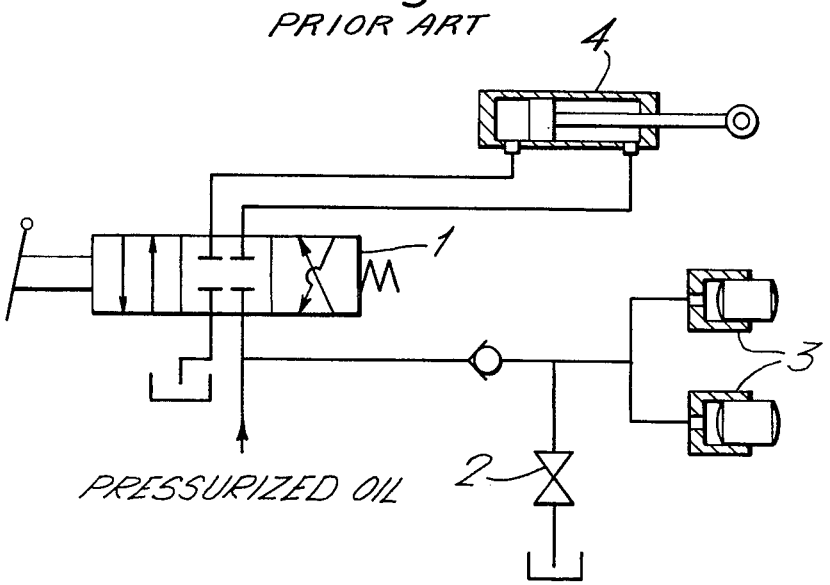
Fig. 1. PRIOR ART
Figure 2:
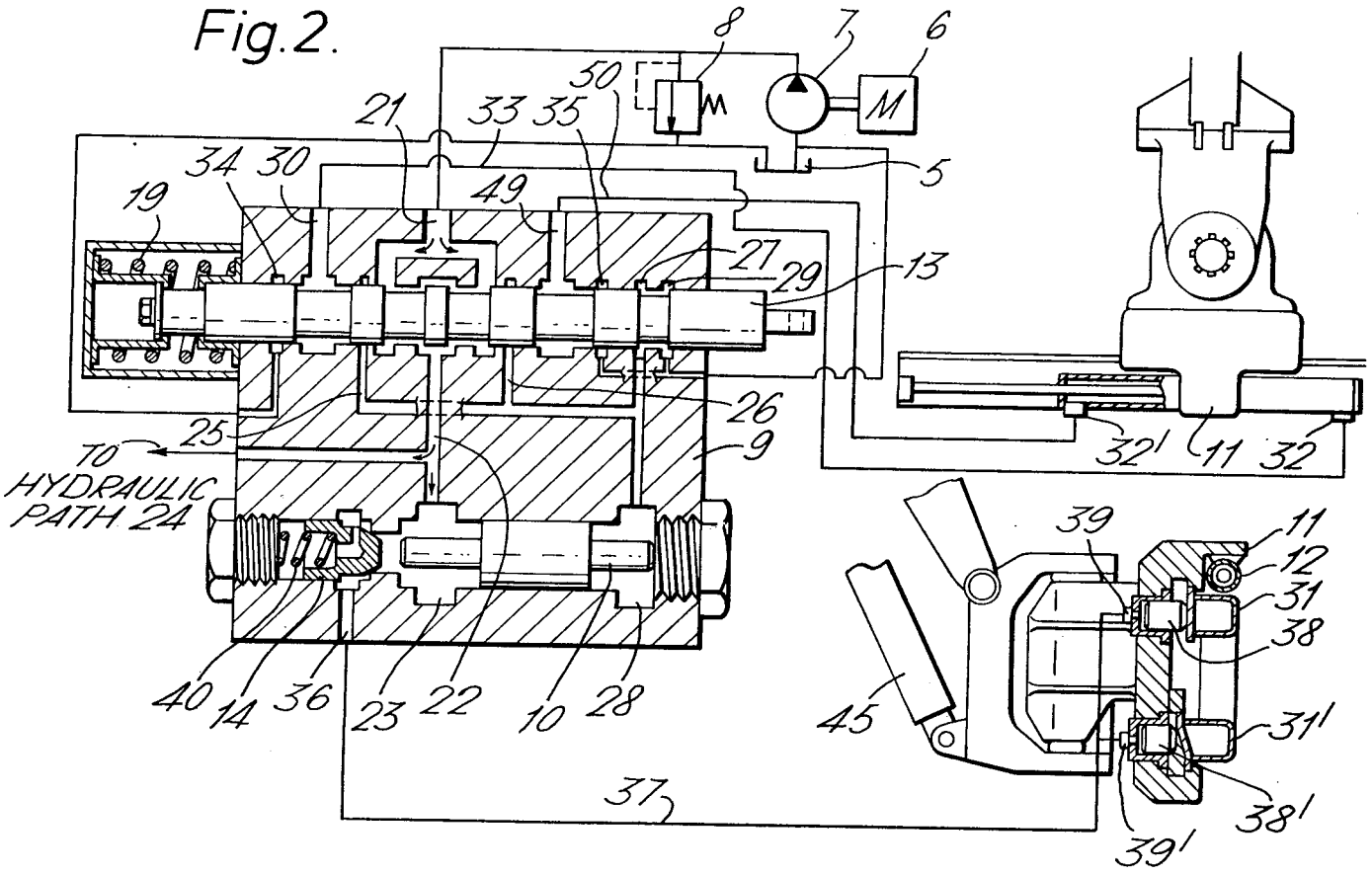
FIG. 2 is a hydraulic circuit diagram of an excavating apparatus showing one preferred embodiment of the present invention.
Figure 3:
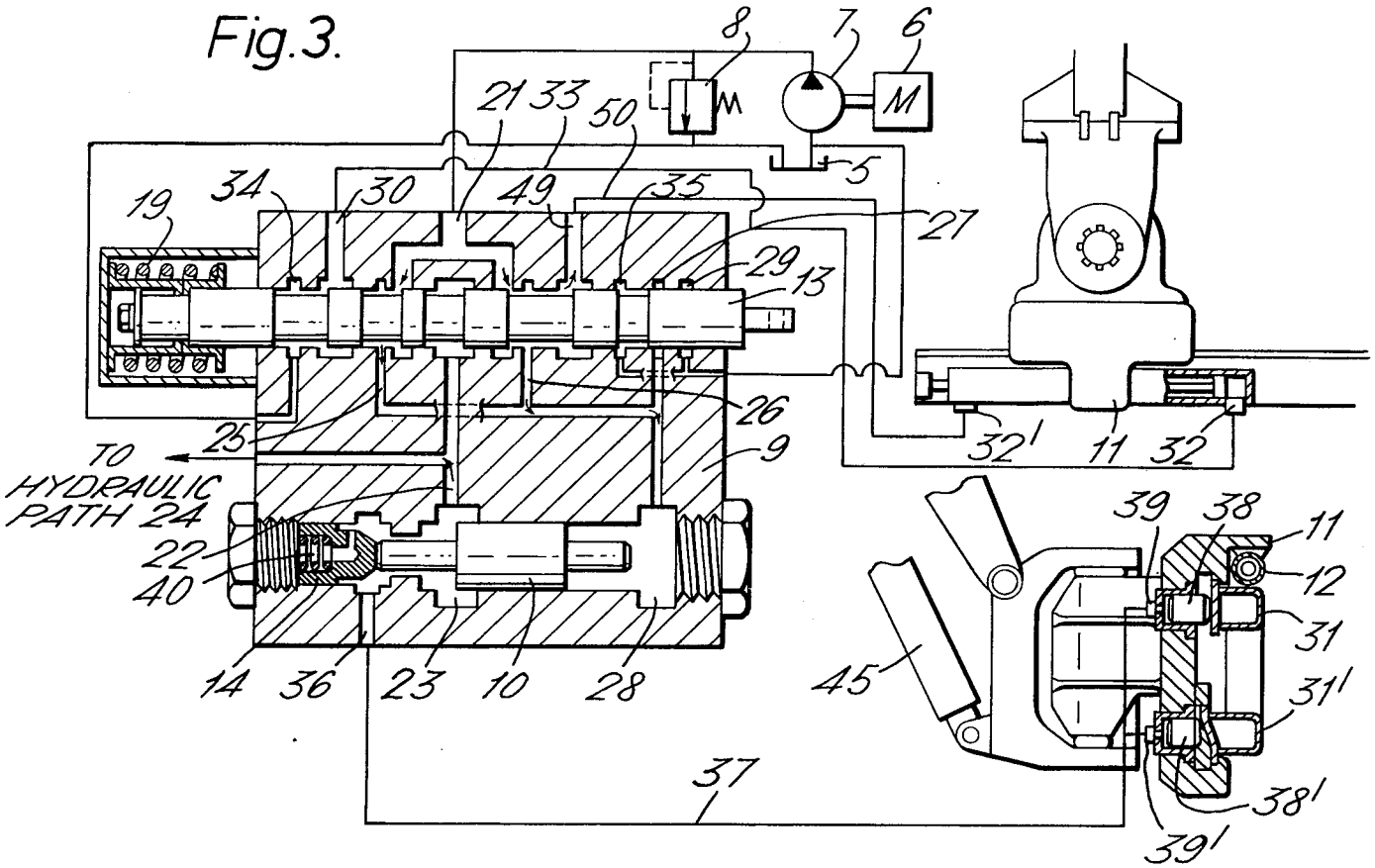
FIG. 3 is a hydraulic circuit diagram of the same apparatus but in a different operating state from that shown in FIG. 2.
Figure 4:
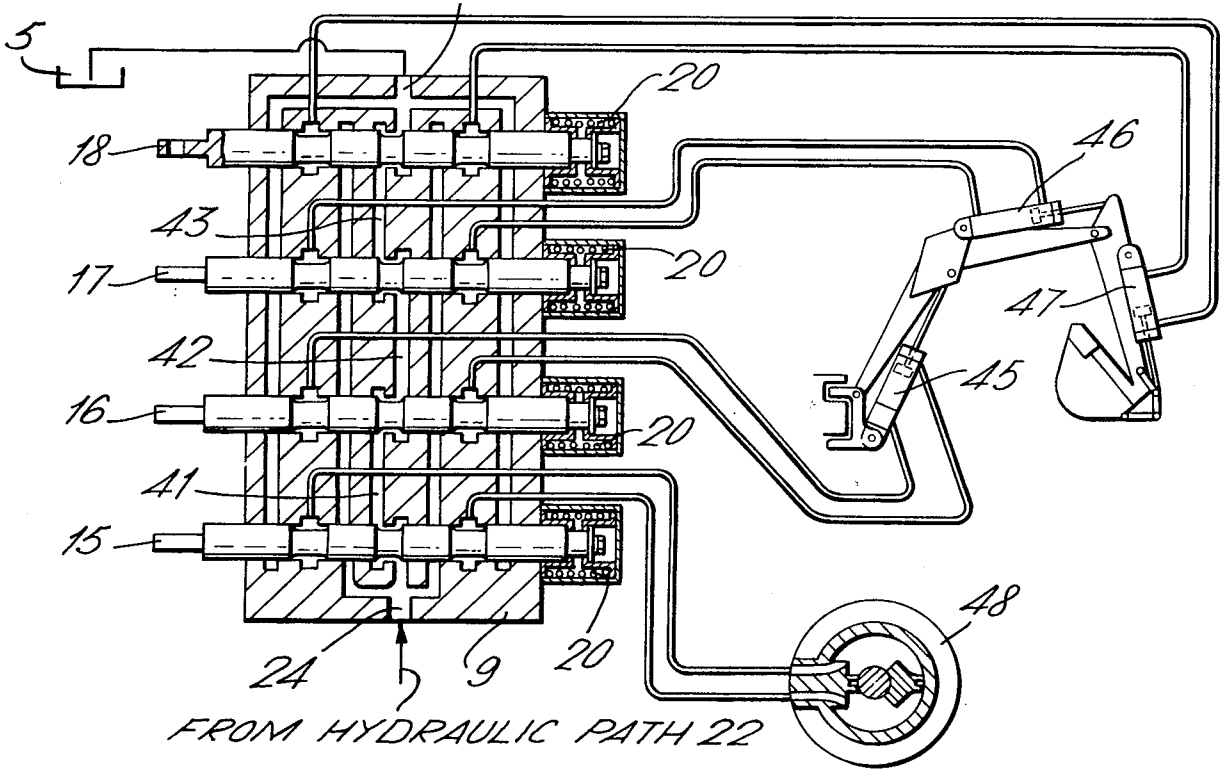
FIG. 4 is a hydraulic circuit diagram of the same excavating apparatus.

FIG. 2 is a hydraulic circuit diagram for hydraulic slide means including a hydraulic fastening circuit which shows one preferred embodiment of the present invention as formed integrally with a hydraulic circuit for an excavating apparatus, FIG. 3 is a hydraulic circuit diagram for explaining the operating state of the embodiment in FIG. 2, and FIG. 4 is a hydraulic circuit diagram of a back-hoe excavating apparatus. In these figures, reference numeral 5 designates an oil reservoir, numeral 6 designates a prime motor, numeral 7 designates a pump and numeral 8 designates a relief valve for controlling the circuit pressure. Numeral 9 designates a housing which accommodates in its upper portion a switching spool valve 13 for controlling operation of a pilot piston 10, operation of a piston-cylinder assembly 12 for moving a back-hoe mast 11 and a check valve 14 disposed coaxially with the pilot piston 10. The housing 9 also accommodates in its lower portion switching spool valves 15, 16, 17 and 18 (see FIG. 4) for an excavating apparatus. Reference numerals 19 and 20 designate back springs for the switching spool valves 13, 15, 16, 17 and 18. Numeral 21 designates a hydraulic path extending from the pump 7, and numeral 22 designates another hydraulic path which, when spool valve 13 is in a neutral state, communicates with the hydraulic path 21 and with a pressure chamber 23 of the pilot piston 10 on the side of the check valve 14, and which also communicates with a hydraulic path 24 for the excavating apparatus located in the lower portion of housing 9. Reference numerals 25, 26 and 27 designates hydraulic paths which communicate with a pressure chamber 28 on the side of the pilot piston 10 opposite to the check valve 14. The paths 25, 26 and 27 communicate, in a neutral state of the spool valve 13, with a hydraulic path 29 which is in turn connected to the oil reservoir 5. Reference numeral 30 designates a hydraulic path connected via a conduit 33 to a port 32 of the piston-cylinder assembly 12 fixedly secured to the back-hoe mast 11, one end of a rod of the piston-cylinder assembly 12 being fixedly secured to back-hoe frames 31 and 31'.

Reference numerals 34 and 35 designate hydraulic paths communicating with the oil reservoir 5. Numeral 36 designates a hydraulic path communicating via a conduit 37 with cylinder ports 39 and 39' of pistons 38 and 38', respectively, which fasten the back-hoe mast 11 to beams 31 and 31' of the back hoe support frame, and numeral 40 designates a back spring which urges the check valve 14 rightwardly to close the valve 14. In addition, the hydraulic path 24 communicates with the hydraulic path 22 in the upper portion of the valve housing 9, and also in a neutral state of the spool valves 15, 16, 17 and 18 communicates with center by-pass hydraulic paths 41, 42, 43 and 44 and eventually communicates with the oil reservoir 5. Reference numeral 45 designates a boom cylinder, numeral 46 designates a dip stick cylinder, numeral 47 designates a bucket cylinder, numeral 48 designates a revolution motor for the back-hoe excavating apparatus, and numeral 49 designates a hydraulic path connected via a conduit 50 to a port 32' of the piston-cylinder assembly 12.

Explaining now the operation of the embodiment shown in FIGS. 2 and 4 for moving the mast to the left, when the switching spool valve 13 is in its neutral position as shown in FIG. 2 and the switching spool valves 15, 16, 17 and 18 in FIG. 4 are also in their neutral positions, the oil in the oil reservoir 5 is passed to the hydraulic paths 21, 22 and 24 by the pump 7 which is in turn driven by the prime motor 6, and the pressurised oil in these hydraulic paths is returned to the oil reservoir 5 via the center by-pass hydraulic paths 41, 42, 43 and 44. Subsequently, if the switching spool valve 13 is pushed in while the switching spool valves 15, 16, 17 and 18 remain in their neutral positions, then the hydraulic paths 21 and 22 are disconnected from each other, the hydraulic paths 21 and 25 and the hydraulic paths 25 and 49, respectively, enter into communication with each other, and the hydraulic paths 27 and 29 are disconnected from each other. If the switching spool valve 13 is pushed in further, the hydraulic path 21 and the hydraulic paths 26 and 49 enter into communication with each other. Then, the pressurised oil fed by the pump 7 enters the pressure chamber 28 and pushes the pilot piston 10 to displace it leftwardly, and simultaneously therewith the left end of the pilot piston 10 pushes the check valve 14. As a result of the fact that the hydraulic path 36 is connected to a drain through the pressure chamber 23, hydraulic paths 22 and 24, and center by-pass hydraulic paths 41, 42, 43 and 44, the fastening between the back-hoe support beams 31 and 31' and the back-hoe mast 11 is released. Simultaneously therewith, the pressurised oil pushes the cylinder tube 12 to cause the back-hoe mast to slide to the left as viewed. At this moment, although the presurrised oil for releasing the fastening and that for slide movement are simultaneously applied, the slide movement is allowed only after the fastening has been released. Then the hydraulic path 30 communicates with the return hydraulic path 34. In this way, the back-hoe mast 11 is caused to slide laterally to any arbitrary position, and when this slide movement is finished, the switching spool valve 13 is returned to its neutral position by the back spring 19. Subsequently, when any one of the switching spool valves 15, 16, 17 and 18 for the excavating apparatus in FIG. 4 is operated, a hydraulic pressure equal to the hydraulic pressure in the operated actuator arises in the pressure chamber 23 which communicates with the hydraulic paths 21 and 22, the pilot piston 10 is pushed to the right as viewed, returning to the state shown in FIG. 2, and therefore, the fastening pistons 38 and 38' can be fastened to the back-hoe support beams 31 and 31', respectively, with a hydraulic pressure equal to the hydraulic pressure in the operated actuator. It is to be noted that owing to the existence of the check valve 14, the hydraulic pressure in the fastening cylinder ports 39 and 39' can be maintained always at the highest hydraulic pressure among the hydraulic pressures in the respective operated actuators for the excavating apparatus, and the fastening is carried out with this highest hydraulic pressure.

A separate explanation of the operation of the embodiment to move the mast to the right is not provided, because it is like that just set forth, excepting that the spool valve 13 is pulled out from its neutral position.

Figure 5:
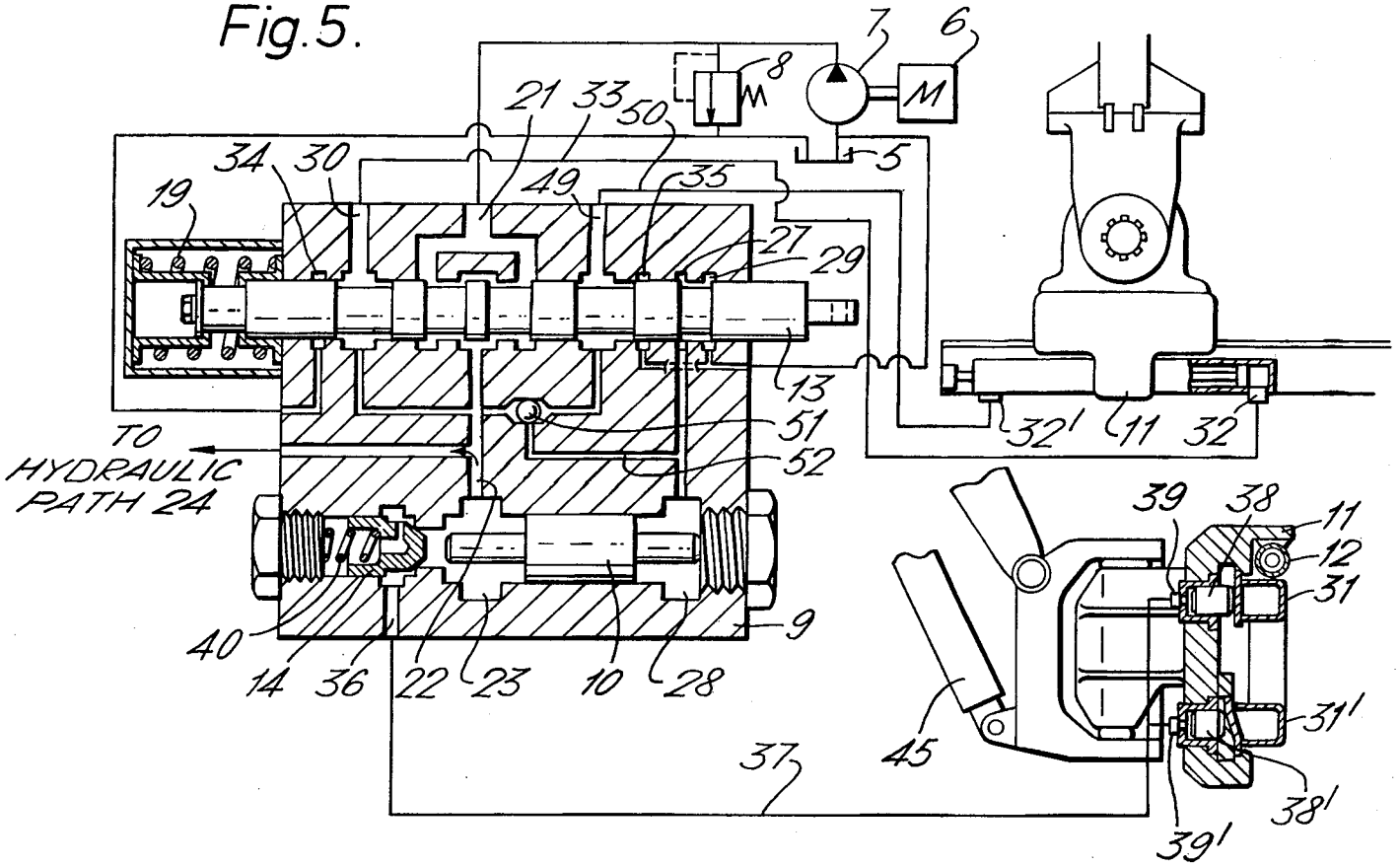
FIG. 5 is a hydraulic circuit diagram of an excavating apparatus showing another preferred embodiment of the invention that is different from that shown in FIG. 2.

Next, a second embodiment shown in FIG. 5 will be described. This embodiment is modified in that the hydraulic paths 25 and 30 and the hydraulic paths 26 and 49, respectively, in the embodiment shown in FIG. 2 are united into hydraulic paths 30 and 49, respectively, and that these hydraulic paths 30 and 49 are connected to each other through a double check valve 51 and further communicate with a pressure chamber 28 through a hydraulic path 52. However, this embodiment is not different in functions and effects from the first embodiment.

Figure 6:
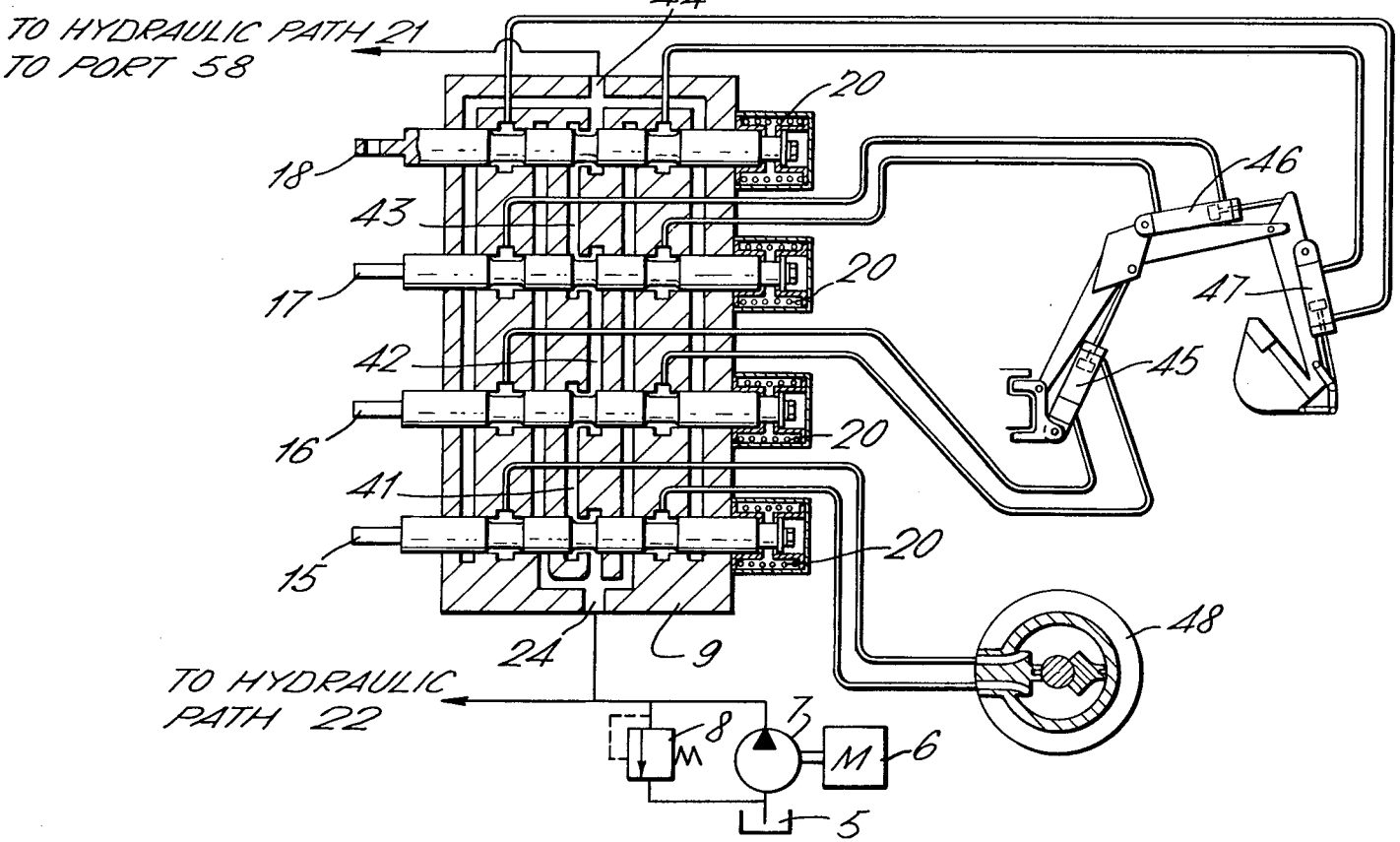
FIGS. 6 and 7 are hydraulic circuit diagrams of an excavating apparatus showing still another embodiment of the present invention.
Figure 7:
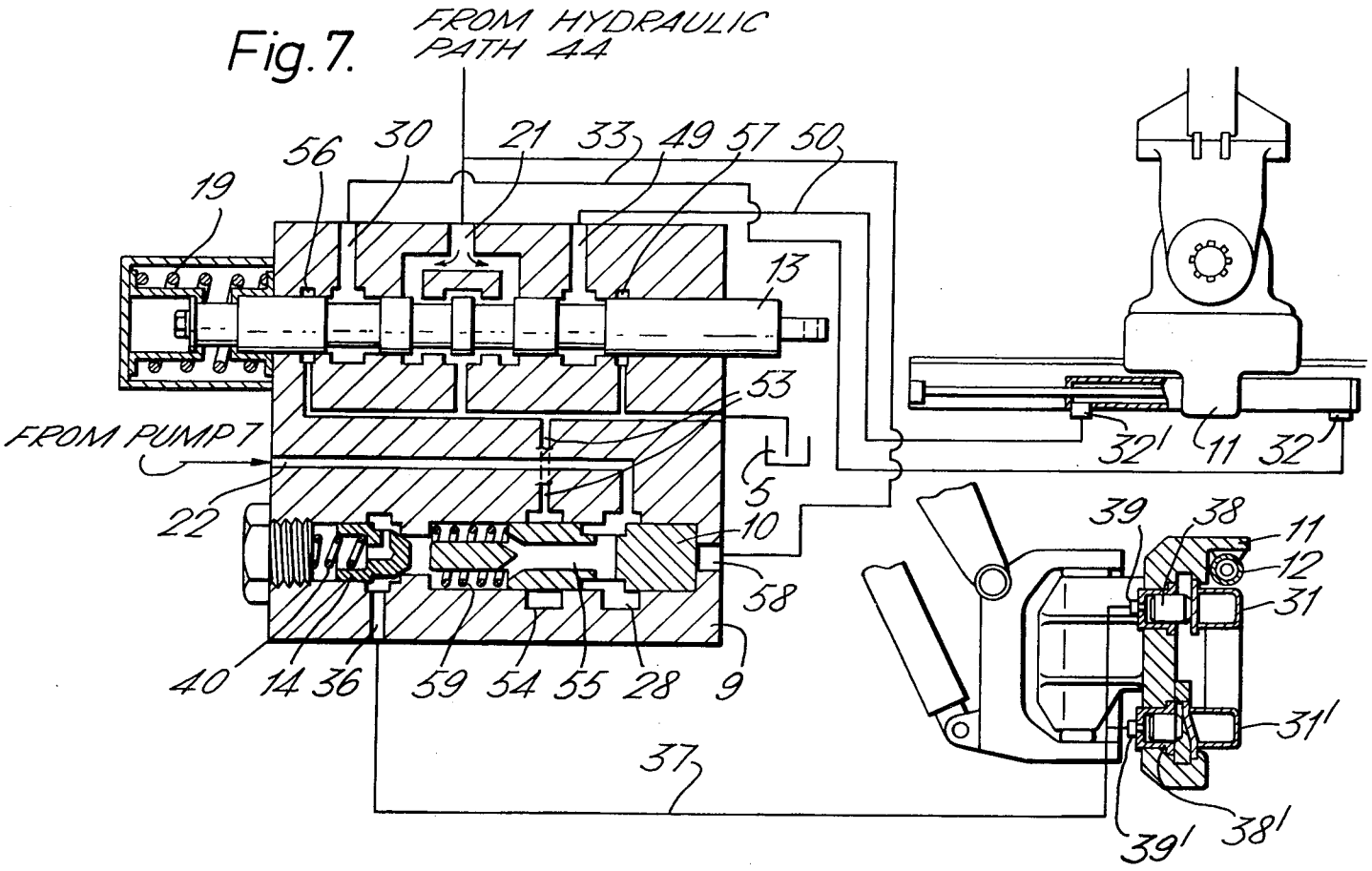

Explaining now the structure of a third embodiment illustrated in FIGS. 6 and 7, reference numeral 9 designates a housing which accommodates in its upper portion a switching spool valve 13 for controlling operation of a pilot piston 10 having a hydraulic path 55 therewithin and being switchable between hydraulic paths 53 and 54 communicating with an oil reservoir 5 and a pressure chamber 28. The switching spool valve 13 also controls operation of a piston-cylinder assembly 12 for causing a back-hoe mast 11 to side-slide, and a check valve 14 disposed coaxially with the pilot piston 10. The housing 9 also accommodates in its lower portion switching spool valves 15, 16, 17 and 18 for an excavating apparatus. Reference numerals 19 and 20 designate back springs for the switching spool valves 13, 15, 16, 17 and 18. Numeral 21 designates a hydraulic path which in a neutral state of the switching spool valves 15, 16, 17 and 18 communicates with a hydraulic path 24 and center by-pass hydraulic paths 41, 42, 43 and 44 in the lower portion of the housing 9, and which in a neutral state of the switching spool valve 13 communicates with hydraulic paths 56 and 57 both extending to the oil reservoir 5. Numeral 22 designates a hydraulic path communicating with a pressurised oil path which extends from a pump 7. Numeral 30 designates a hydraulic path connected via a conduit 33 to a port 32 of a piston-cylinder assembly 12 which is fixedly secured to a back-hoe mast 11 and one end of whose rod is fixedly secured to the frames 31 and 31'. Numeral 49 designates a hydraulic path connected to a port 32' of the piston-cylinder assembly 12 through a conduit 50. Numeral 58 designates a port communicating with hydraulic paths 44 and 21. Numeral 59 designates a spring for pushing the pilot piston 10 to the right as shown, and numeral 36 designates a hydraulic path communicating through a conduit 37 with cylinder ports 39 and 39' of the pistons 38 and 38', respectively, which fasten the back-hoe mast 11 to the back-hoe frames 31 and 31'. Although the above-described structure is partly different from that of the first embodiment shown in FIGS. 2 to 4, this embodiment is not different in functions and effects from the first embodiment.

As described in detail above, according to the present invention, both actuation of a cylinder for leftward and rightward transfer movement and actuation of a pilot piston for a pilot-operated check valve present in a hydraulic path communicating with a fastening hydraulic cylinder in a hydraulic transfer and fastening apparatus are carried out with a hydraulic pressure on the pressurised side of a cylinder for slide movement by means of a single switching valve. Thereby a sequence of operations of [release of hydraulic clamping]→ [leftward or rightward transfer of clamping apparatus]→ [hydraulic clamping] can be successively performed in response to a single manipulation, and therefore, the present invention has an advantage that it can provide a hydraulic circuit which is very easy in manipulation, reliable in operation, and less expensive. It is to be noted that the present invention is effective when applied to an apparatus that necessitates both transfer and fixing such as, for example, a side-slide type of back-hoe.

We claim:

1. A hydraulic control system for an object moving and clamping arrangement that includes:

a support;

an object mounted on the support for movement axially therealong;

hydraulic piston and cylinder means for moving the object along the support;

hydraulically operated, releasable clamp means for locking the object at any selected position on the support, and which must be released to permit the object to be moved along the support;

a source of pressurized fluid for powering said moving means, and said clamp means;

and conduit means for communicating said source with said moving means and with said clamp means;

said control system comprising:

a switching valve interposed in said conduit means between said source and said moving means and clamps means;

the switching valve including a housing and a valve body movably mounted therein between a neutral position, and at least one activating position for effecting advancement of the object along the support;

an activator for the valve body, accessible from the exterior of the valve housing for shifting the valve body between the neutral and activating positions;

a pilot piston;

cylinder means housing the pilot piston for sliding movement therein between a first position and a second positon;

this cylinder means also housing a check valve body and means normally resiliently urging the check valve body to a first position, but being disposed to be moved to a second position by engagement with the pilot piston as the pilot piston is moved from the first position thereof to the second position thereof;

the check valve body being interposed in said conduit means between the switching valve body and the clamp means;

the conduit means further including, when the switching valve body is in the neutral position thereof:

(a) a hydraulic path from the source, through the housing, past the switching valve body and into the cylinder for the pilot piston at a location which tends to force the pilot piston away from the check valve and toward the first position of the pilot piston and tends to supply pressurized hydraulic fluid past the check valve to maintain the hydraulically operated clamp means pressurized and thus locked;

(b) a hydraulic path from the source, through the housing, past the switching valve body and back to said source, so as a by-pass for excess pressurized fluid;

the conduit means further including, when the switching valve body is in said activating position thereof:

(c) a hydraulic path from the source, through the housing, past the switching valve body and into the cylinder for the pilot piston at a location which tends to force the pilot piston towards the check valve, towards the second position of the pilot piston and the second position of the check valve, thereby permitting pressurized fluid to back flow from the clamp means, past the check valve and into the cylinder for the pilot piston, to depressurize and thus unlock the clamp means;

(d) a hydraulic path from the source, through the housing, past the switching valve body and to one side of the piston and cylinder means for pressurizing that side in order to move the object along the support;

(e) a hydraulic path from the other side of the piston and cylinder means and back to the source for draining hydraulic fluid from that side of the piston and cylinder means; and (f) a hydraulic path from the source, through the housing, past the switching valve body and back to said source, as a by-pass for excess pressurized fluid, the pilot piston thereby enabling the operation of only said activator to switch the object moving and clamping arrangement between one mode wherein the clamping means is locked and the object is disposed at a chosen, fixed location along the support, and another mode wherein the clamping means is unlocked and the object is moved along the support in a desired direction;

the object moving and clamping arrangement further includes at least one other hydraulically operated device;

the conduit means also communicating said source with said other device;

the control system further including:

said switching valve also being interposed between said source and said other device;

the conduit means further including, when the switching valve body is in the neutral position thereof:

(g) a hydraulic path from the source, through the housing, past the switching valve body, to said other device for powering said other device, and back to said source;

the hydraulic path (g) communicating with the hydraulic path (a) between the switching valve body and the cylinder for the pilot piston, whereby as the switching valve body is returned from said activating position to said neutral position, the flow of pressurized fluid to said other device upon activation thereof, will also aid to return the pilot piston to the first position thereof and ensure full pressurization and locking of the clamp means.

2. The hydraulic control system of claim 1, wherein:

the support is constituted by a backhoe support frame and the object is a backhoe mast.

* * * * *